US006886686B2

(12) United States Patent
Anderson

(10) Patent No.: US 6,886,686 B2
(45) Date of Patent: May 3, 2005

(54) DISPENSING CAPSULE FOR A LIQUID CONTAINER

(76) Inventor: Michael R. Anderson, 1355 W. Palmetto Park Rd., No. 129, Boca Raton, FL (US) 33486

( * ) Notice: Subject to any disclaimer, the term of this patent is extended or adjusted under 35 U.S.C. 154(b) by 0 days.

(21) Appl. No.: 10/709,062

(22) Filed: Apr. 9, 2004

(65) Prior Publication Data

US 2004/0188282 A1 Sep. 30, 2004

Related U.S. Application Data

(63) Continuation-in-part of application No. 10/605,873, filed on Nov. 3, 2003, and a continuation-in-part of application No. 10/155,461, filed on May 24, 2002, now Pat. No. 6,644,471.

(51) Int. Cl.[7] ..... B65D 25/08
(52) U.S. Cl. ..... 206/219; 206/221
(58) Field of Search ..... 206/219–222, 206/568; 215/DIG. 8; 222/80, 83, 129

(56) References Cited

U.S. PATENT DOCUMENTS 3,156,369 A 11/1964 Bowes et al.
4,638,927 A 1/1987 Morane
5,246,142 A 9/1993 DiPalma et al.
5,370,222 A 12/1994 Steigerwald et al.
5,509,530 A * 4/1996 Wilson ..... 206/220
5,692,644 A 12/1997 Gueret
5,746,313 A * 5/1998 Wilson ..... 206/220
5,772,017 A * 6/1998 Kang ..... 206/222
5,863,126 A 1/1999 Guild
6,209,718 B1 * 4/2001 Mollstam et al. ..... 206/222
6,360,886 B1 * 3/2002 Welsh ..... 206/219
6,644,471 B1 * 11/2003 Anderson ..... 206/222

* cited by examiner

*Primary Examiner*—Luan K. Bui
(74) *Attorney, Agent, or Firm*—Malin, Haley & DiMaggio, P.A.

(57) ABSTRACT

A two piece sealed capsule that is inserted into a liquid bearing container wall or neck of a bottle, said capsule being a receptacle for sealably containing a liquid and/or dry material and a dispenser for releasing the material when desired into the container. The top of the capsule is depressed manually forcing a plunger tube connected to the bottom of the capsule to rip away the bottom and side portion dispensing the material. The present invention allows the use of materials that would discolor, degrade or interact with other substances when added to the contents of the bottle, to remain stable and/or inactive until the time of use.

5 Claims, 3 Drawing Sheets

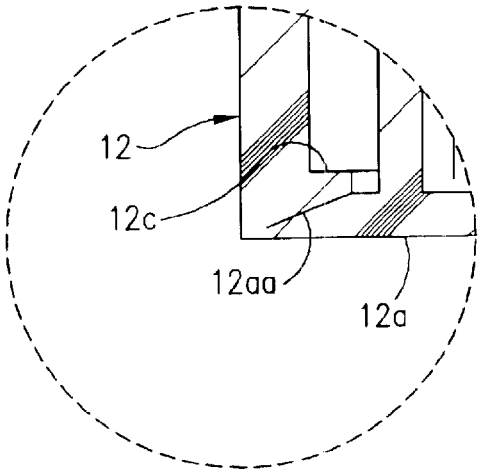
FIG. 4A
FIG. 4
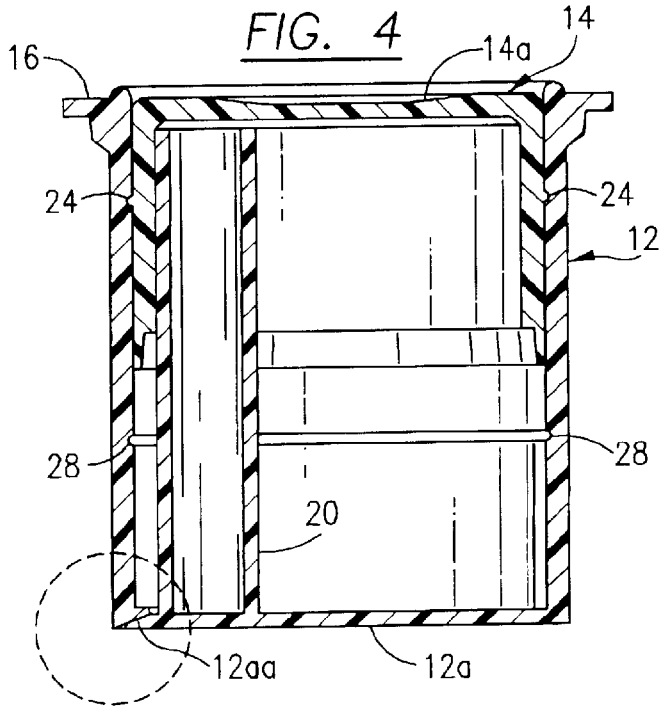
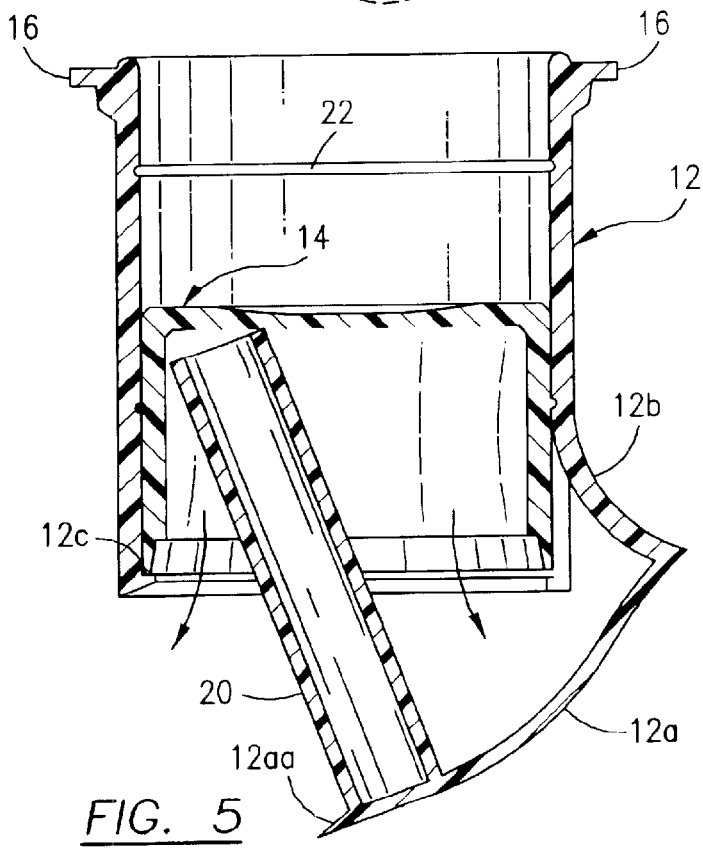
FIG. 5

DISPENSING CAPSULE FOR A LIQUID CONTAINER

This application is a continuation-in-part of U.S. Ser. No. 10/155,461 filed May 24, 2002, U.S. Pat. No. 6,644,471, and U.S. patent application Ser. No. 10/605,873 filed Nov. 3, 2003.

BACKGROUND OF THE INVENTION

1. Field of the Invention

This invention relates to a liquid and/or dry ingredient dispensing capsule that is mounted to the body of a bottle, pack, pouch, carton, can or any other liquid container or inserted into the neck or into the cap. The capsule stores liquid and/or dry substances which can be rapidly dispensed into the container by manual activation when desired and the mixed contents can be thereafter readily consumed by the user.

2. Description of the Prior Art

Many foods, drugs, cosmetics, mouth washes, adhesives, polishes, cleansers, dyes and other substances are compounds or mixtures that are frequently supplied in liquid, powder or crystal form and do not retain their stability, strength and effectiveness for long after the ingredients have been mixed in solution or suspension with a different liquid. This incompatibility after mixing therefore mandates that the product be utilized relatively soon after mixture to obtain full strength benefits or to prevent loss of effective strength, deterioration, discoloration, interactions and reduce effectiveness. It is also important that admixtures of various ingredients be done under conditions wherein a measured amount of one ingredient is added to a measured amount of the other liquid or chemical to insure that proper results are obtained. The process of loss of effectiveness is often termed "shelf life." Once two different chemicals are combined, the process of deterioration often begins.

Another concern involves merchandising of certain products, where it is frequently desirable to supply two companion products to the consumer in a single package. Thus, many products are, by their very nature, required to be used by the consumer shortly after their manufacture and mixture as they lose certain desirable characteristics with a short period of time, yet the product can be stored for extended periods of time if one ingredient is maintained separate from the other. In such case, the two ingredients may be mixed together to form the desired product shortly before use. In marketing such goods, it obviously is desirable that both ingredients be sold as part of the same package. From an aesthetic as well as a handling standpoint, it is desirable that but a single package be utilized for maintaining such compounds separated.

The use of conventional liquid containers such as plastic bottles for carrying water, juices, power drinks and other desirable liquids for human consumption is quite well known. There are, however, several non-active and active substances such as activated oxygen, vitamins, minerals, herbs, nutrients and flavors that would be desirable to be added to liquids such as water, juices or other beverages to give the consumer added benefits, particularly those useful for the health of the consumer. Many of the substances, however, that provide additional benefits when mixed into another liquid have short shelf lives, discolor, interact or degrade quickly when combined with liquids or other substances. Therefore, many beverages are currently sold without the added beneficial ingredients.

It is known in the art to provide dispensers containing a concentrate of soluble materials to a fixed quantity of solute, usually water, for dispensing. Thus, the prior art teaches containers for beverages wherein the interior of the container is divided into a compartment having a basic ingredient and a compartment which can be ruptured so as to mix, within the container the basic ingredient and some form of modifier, diluent or flavoring. The basic reason for this prior art container is to provide the mixing action at the time of consumption since prior mixing would have adverse effects. The basic ingredient is often not suitable for consumption by itself and requires mixing with a diluent/modifier prior to consumption.

Prior art intra-container mixing prior to use was disclosed in U.S. Pat. No. 5,370,222 to Steigerwald comprising an open threaded container containing a liquid, a powder containing releasable receptacle sealed with foil which is cut by a cutting mandrel during screwing of the receptacle onto the container. Unlike the present invention, the Steigerwald arrangement situates a powder containing receptacle on top of rather than within the container and utilizes a cutting means rather than a two-part sealed plunger means to confine then discharge the receptacle contents.

U.S. Pat. No. 5,863,126 to Guild discloses a baby bottle fluid mixing system comprising a pre-stored powdered substance confined within a first upper container screw disposed atop a second lower container separated by an internal stemmed disk sealed in a snap fit arrangement at the aperture between the bottles, which descends into the lower bottle after removal from the aperture for use. The present invention discloses a capsule body insertable in but not screwed onto a liquid containing bottle and further comprises two sealable plugs or closures rather than one snap fit plug and a disposable, non-reusable interior mounted capsule versus top threaded reusable upper container for pre-stored dry or liquid.

Another such device for separate storage and subsequent mixing of two products was disclosed in U.S. Pat. No. 5,246,142 to DiPalma which comprised a first ingredient container, a second ingredient dispenser compartment plunger arrangement with a weakened wall region inserted within and separated from the container, a removable container closure connected to the plunger and a plunger projection for engagement which ruptures the weakened wall region to release the second ingredient into the first ingredient container. Unlike the present invention, DiPalma's singular sealing means is the reservoir for the second ingredient and fails to create upon activation an orifice for immediate dispensing of the mixed products.

U.S. Pat. No. 5,692,644 to Gueret discloses a container separately storing, then mixing and dispensing two products in which a first liquid containing bottle is separated by a movable wall from a second reservoir containing powder. Force applied to a cylindrical piston in the direction toward the dispensing orifice of the container cuts the seal between the two reservoirs, thereby facilitating the combination and mixing of the two products within the first reservoir of the container. The Gueret apparatus differs from all embodiments of the present invention in that the piston is an integral portion of the slideable base which is snapably attached to the bottle and when compressed with external manual pressure breaks the seals, pushing the contents up into the bottom portion of the liquid-containing bottle thereby accomplishing the mixing of the two products and simultaneously reducing the exterior dimensions of the bottle. The present invention dispenses the dry product without a piston or slideable base integrated within the bottle nor does the overall size of the bottle change during use.

Another separate storage and dispensing device was disclosed in U.S. Pat. No. 4,638,927 to Morane which comprised a bottle for liquid having at its neck a leak proof envelope separately storing and enclosing additional product, with a slidable push button perforator in the cap on the bottle neck which opens the envelope to discharge the envelope contents into the liquid in the bottle, thereafter being dispensed through a duct in the cap rather than passing through the perforated center cap area as is the case with the present invention. Morane is also not a two plug system as is the present invention.

U.S. Pat. No. 3,156,369 issued to Bowes, et al. on Nov. 10, 1964 shows a bicameral container that includes a bottle cap dispenser. No provision is made to retain the dispenser in the container to allow consumption of the mixed ingredients.

Child safety is a concern with respect to dispensing containers to ensure that the dispensing process does not entail creating small frangible items or pieces of foil or paper that could harm a child.

The cost of manufacturing must always be considered in determining whether or not a containing dispenser is practical in everyday use.

The present invention provides a liquid and/or dry ingredients containing capsule that is mounted in the body wall or inserted into any type liquid container including packs, bags, cans and plastic or glass bottles. With a bottle as an example, the capsule may be mounted typically within the neck or throat of a liquid container having a conventional screw off cap, such as a bottle of water. The capsule includes a manual dispenser. The capsule ingredients are completely sealed within the capsule body, and remain separated from the liquid in the bottle until the exact moment of usage, which is determined by the consumer by manually dispensing the capsule ingredients (powder or liquid). The capsule can also be conveniently mounted in the throat of the bottle or at the bottling factory under a standard liquid dispenser cap without interfering with the sealing of the bottle itself in its normal capping operation. The capsule can be mounted to or within any type of package or carton through the package wall at any location. Thus, active ingredients, e.g. activated oxygen, vitamins, herbs, nutrients or other substances having a short activity life (shelf life) when added to a particular liquid can now be safely and sealably stored in a capsule until time for use and can be subsequently added to the desired liquid, thereby ensuring that the shelf life and time of activity of the materials are not jeopardized even though they are housed within the liquid container. Once activated, the contents of the bottle can be consumed by the user without removing the capsule.

The present invention also offers the advantage that it does not require significant modification of existing liquid containers, packages, cartons, bottle caps or existing bottles. In fact, it can be inserted into existing bottles without interfering with the sealability of the conventional bottle and bottle cap.

The capsule may be added at the factory to a liquid bearing container and pre-mounted in the container at the factory after the container itself is partially filled with a liquid or used with an existing container. A conventional bottle cap is used to seal the bottle contents, including the capsule. The capsule can be sold separately or prepackaged in the beverage container.

None of the above prior art taken either alone or in combination, describes, suggests or renders obvious the instant invention as claimed.

SUMMARY OF INVENTION

An ingredient dispensing capsule mounted or mountable in a container for sealably containing a liquid and/or powder materials having substantially a cylindrical liquid impervious body of any size or shape but for many cartons, packages and bottle liquid containers, sized in diameter to fit within the inside diameter of a neck or any other location of the bottle, can, carton, pouch, and the like. The capsule is comprised of two interlocking members that form a sealed capsule that is manually activated with a flow-by mounting ring to dispense the bottle contents once activated. Although the cylindrical capsule shape is preferred, any other shaped capsule could be utilized if necessary.

The first member is a cylinder having a sealed closed end and an open end surrounded by an extended annular lip having a plurality of apertures that extend beyond the cylinder wall exterior. The first member inside cylinder wall can have an annular groove below the top opening. The first member is made of a liquid impervious material such as plastic, polypropylene or polyethylene but not limited thereto. Other materials are suitable. However, the first member could also be made of metal, glass or fabric. The sealed bottom end wall of the first member is integrally molded with the cylinder wall as a single piece with the bottom end wall having a thinner annular area near its perimeter to act as a weakened fungible bottom end cap. A vertical plunger tube is molded integrally to the upper surface of the cylinder bottom end wall and is located and offset from the center of the bottom wall to a peripheral edge of the bottom wall.

The second capsule member is a cylinder having an open bottom end and a sealed closed top end. The outside diameter of the second member is less than the inside diameter of the first member, such that the second member fits inside the first member and can be manually pushed as a plunger. The perimeter defining the bottom open end of the second member cylinder formed by the cylinder wall is annular. The second member has an integral molded annular bead or seal that fits in an annular groove inside the first member cylinder wall. The plunger tube extends vertically to almost the top opening of the first member cylinder. The first member cylinder body has a cylindrical wall portion that includes an area of weakening from the bottom wall upwardly on an arc segment of the cylindrical wall approximately half way up the cylindrical wall and about 20 degrees in arc width. In addition, the bottom wall of the first member cylinder has a weakened area around its periphery and is attached as part of the cylindrical wall weakened area to act as one continuous unit of material. When the plunger tube is manually forced downwardly, the bottom wall and part of the cylinder wall separate, dispensing the contents, while remaining attached to the cylinder.

In the preferred embodiment of the invention, the second member sealably fits inside the first member in the unused position, forming a capsule with ingredients stored inside. Since both the first member and the second member are liquid impervious and the second member includes an annular bead near its closed end and the first member has an inside groove near the top of its open end, the first and second members are joined together at the factory after the ingredients which are to be dispensed are first loaded into the first member. The ingredients can be liquid or granular or powder and are placed in the first member at the factory. With the ingredients in place in the first member cylinder, the second member is inserted and fits inside the first member containing the ingredients and is pushed downwardly until the annular bead on the second member engages the first member groove that seals. Thus, the capsule has a closed top and a sealed bottom that act as a unit.

The entire capsule which includes a bottle top opening mounting ring formed by an extended annular lip around the first member could also be mounted permanently into the wall of a carton, package, flexible container. As an example, a bottle of water can be opened by removing its cap and the capsule inserted in the neck and then the cap sealed tightly thereon. The capsule can also be firmly sealably attached through a carton or flexible liquid package wall in a sealed connection through the wall.

At the time of use, the capsule top can be manually depressed, forcing the second member downwardly manually until the plunger tube engages the second member end wall. The rigid plunger tube is forced downwardly against the first member bottom wall ripping and tearing away portions of the first member or bottom wall and side wall along the lines of weakening causing the contents, liquid or powder, to be quickly dispensed by gravity into the liquid in the bottle, which in this example contains water. The different types of ingredients and uses are extensive. Packages for hair coloring, kitchen foods such as steak and marinate or herbs, automotive products and oral tooth care products are a few examples of a variety of products that may require use of two different liquid or powder chemicals that must be separated until actual use.

Once the ingredients are thoroughly mixed with the liquid in the container, the user can drink directly from the bottle in as much as the liquid will flow out of the bottle neck through the apertures disposed in the outer perimeter lip of the first member. Note that the first member interior wall also includes a flange about a third of the way down from the top that engages the lip of the second inner member preventing the second inner member from being plunged or forced into the bottle of liquid. The plunger tube also prevents the second member from falling into the container.

One of the advantages of the present invention is that it does not require additional thin foil seals at either end. The capsule, once sealed at the factory, is self-contained and can be sold independently and later put into a liquid container, pouch, carton, jug, can or the like or can be added at the factory when the liquid is added to the bottle. The purpose of having a separate container is to extend the shelf lives of the combined ingredients contained within the capsule with the container ingredients. Many ingredients have a short shelf life once added to a liquid such as water or other drink. By having the individual capsules that are completely sealed until the time of use, the active ingredients can be kept separate from the main ingredient such as the liquid in the bottle, carton, package or container.

In an alternate embodiment of the invention, the second member closed end could be modified to have a center hole sealed by a removable foil having adhesive. The first member upper perimeter lip apertures would no longer be necessary to permit the user to pour the mixed ingredients out of the container or drink from the container. Liquid would flow through the hole in the second member once the first member bottom cap is ruptured or through a straw.

In yet another embodiment, the capsule is mounted and sealed in the body of a container or package, not at the opening. The container could be molded so that one segment of the capsule is formed with the container body. No flow-by apertures would be necessary.

In yet another embodiment, the capsule could have two or more compartments formed with dividers to separate different chemicals for dispensing from one capsule.

It is an object of the invention to provide an insertable capsule that includes active ingredients that can be readily dispensed into any type of container housing a second material at a desired time, thus not interfering with the shelf life or physical/chemical integrity of the ingredients to be combined.

It is an object of this invention to provide a liquid and/or dry ingredient bearing receptacle that includes a dispenser to allow consumers to dispense the liquid or powder into the liquid bearing container, pouch, package, carton at any time, the capsule being housed within the liquid containing container in a sealed condition.

Still another object of this invention is to provide for sanitary release of the desired ingredients from a capsule of any size or shape into a liquid-containing package at a time selected by the consumer.

In accordance with these and other objects which will become apparent hereinafter, the instant invention will now be described with particular reference to the accompanying drawings.

BRIEF DESCRIPTION OF DRAWINGS

FIG. 4 is a front elevational view in cross section of the invention in a non-activated mode shown without ingredients.

FIG. 4A is a cutaway view of the bottom wall and cylinder wall intersection in cross section.

FIG. 5 is a front elevational view in cross section as the invention would appear after activation. The opposite side view would be a mirror image thereof.

DETAILED DESCRIPTION

Figure 1:
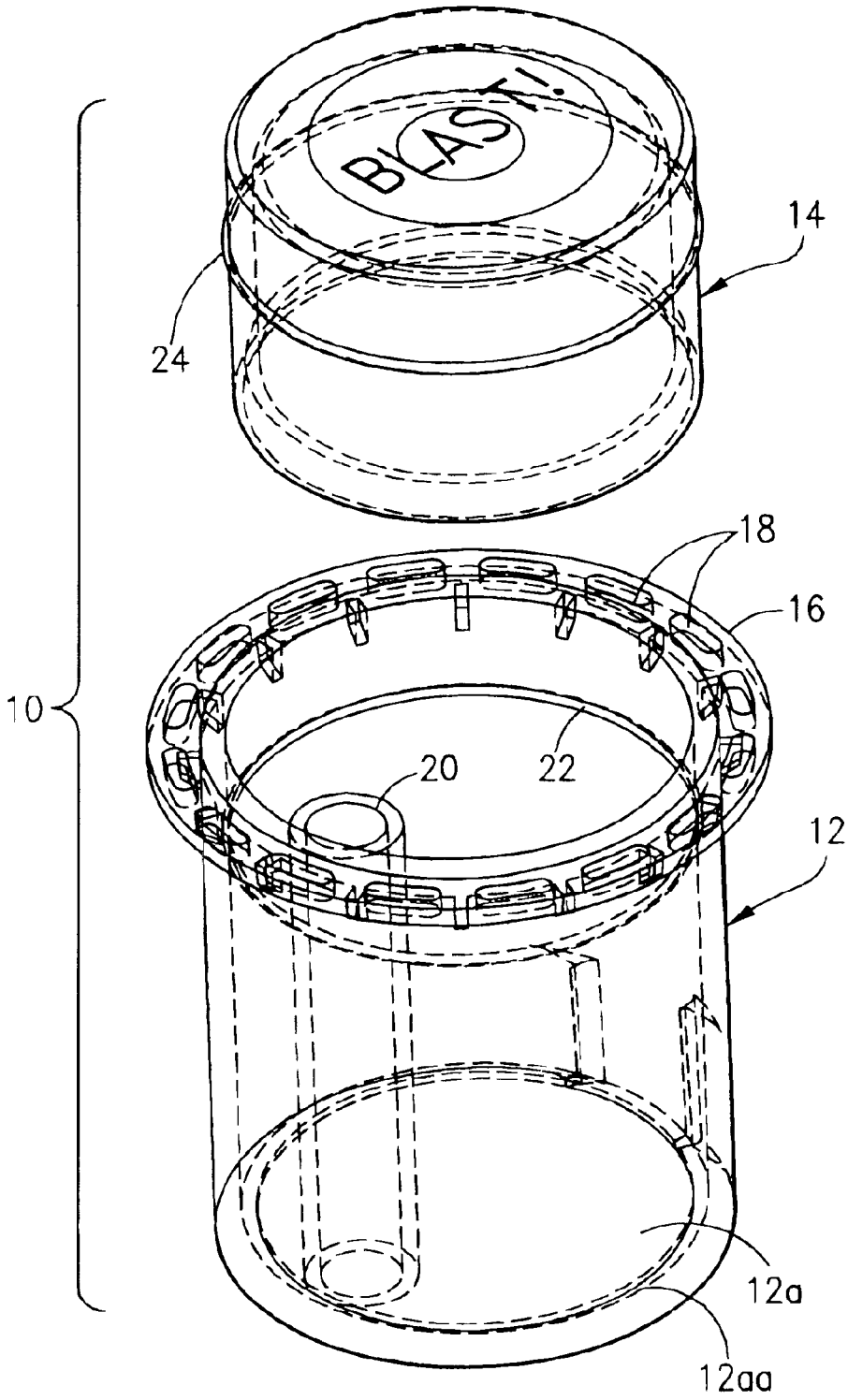
FIG. 1 shows an exploded perspective view of the present invention.

Referring now to the drawings and in particular FIG. 1, the present invention is shown in FIG. 1 at 10 comprised of a cylindrical water impervious plastic first member 12 having a cylindrical body that includes a sealed bottom 12*a* that is integrally formed with the cylinder 12 through a weakened wall area 12*aa* which defines the perimeter of the bottom of the first member 12. An annular lip 16 is positioned around the top opening of the cylinder 12 and includes a plurality of apertures 18 disposed around the perimeter that extend beyond the inside wall of the first member cylinder 12. The interior wall of first member 12 includes an annular groove 22 that receives a bead on the second member 20. A plunger tube 20 also engages second member 14 preventing second member from falling into the container (not shown).

Figure 2:
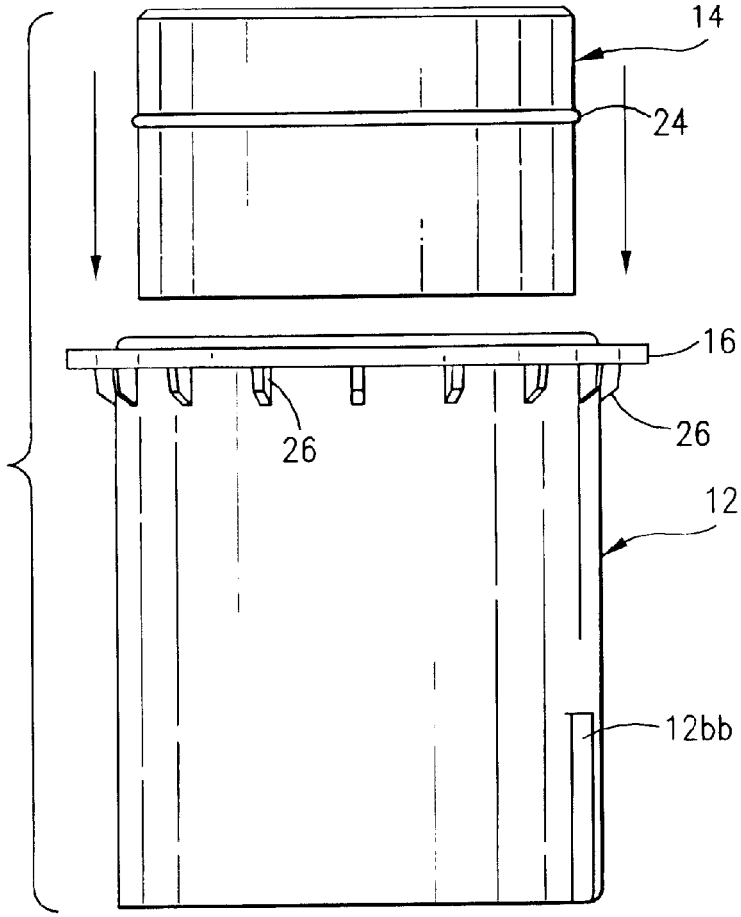
FIG. 2 shows an exploded side elevational view of the present invention.

Referring now to FIG. 2, the present invention is shown with the second member 14 which is cylindrical having an open bottom above the first member 12 that is used to contain ingredients that will ultimately be dispensed into another container such as a bottle or package. Second member 14 which is in effect the mechanical plunger includes an integrally formed annular bead 24 that extends above the surface of the outside cylinder wall of second member 14. The purpose of the annular bead 24 is to seal second member 14 inside first member 12 at a predetermined location once the ingredients have been placed in second member 12. Also note on the outside wall of first member 12, there is a line of weakening shown represented by line 12*bb* 1on one lower area of the outside wall of first member cylinder 12.

Also note in FIG. 2, the extended annular lip 16 includes flow-by apertures and extends outwardly around the open top portion of first member 12. The purpose of lip 16 is provide a mount inside a bottle cap neck to support the entire capsule inside a bottle without the capsule 10 falling into the container. The lip 16 also includes a plurality of apertures that allow liquid to flow by the entire outside capsule body through the apertures so that a person can drink out of a container containing a liquid that has been mixed with the ingredients after the device is activated. Further mounting members 26 are radial arms protruding away from the sides of first member 12 disposed around its upper periphery.

Figure 3:
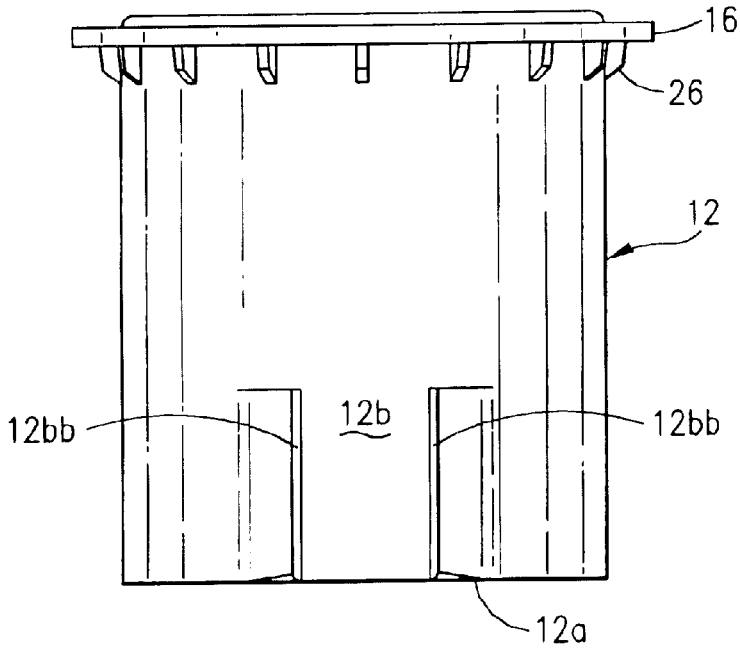
FIG. 3 shows a side elevational view in the direction of the lines of weakening of the invention.

Referring now to FIG. 3, a front elevational view shows the entire area of weakening 12*b* which is substantially rectangular section of the curved cylindrical wall forming the cylindrical body wall for first member 12. The purpose of the lines of weakening 12*bb* is to provide a substantial area 12*b* in the first member 12 wall that can be torn away and separated from the main body 12 when the plunger rod 20 is activated by depressing the second member 14.

Referring now to FIGS. 4 and 4A, the invention is shown in a non-activated disposition. What is not shown in FIG. 4 are the ingredients which would have already been provided to the inside chamber formed by the union of the first member 12 and the second member 14 which are shown in a sealed arrangement. No ingredients are shown in the embodiment in FIG. 4 even though it would normally be filled with ingredients, either powder or liquid.

Referring now to FIG. 4A, the junction point between the side cylindrical body 12 and the bottom wall 12*a* include a line of weakening 12*aa* all the way around the base or bottom wall 12*a*.

Referring now to FIG. 5, the invention is shown after it has been activated and the ingredients have been dispensed. It can be readily seen that second member 14 has been depressed downwardly. The second member 14 cannot be pushed any farther because of an annular lip 12*c* above the bottom weakened wall 12*a* having a diameter that is smaller than the outside diameter of second member 14. More importantly, however, is the position of the plunger tube 20 that is integrally formed with the weakened bottom 12*a*. Because of the lines of weakening 12*a*, when the second member is depressed downwardly, the bottom wall 12*a* is ruptured separating the wall 12*a* from the cylindrical body 12 including a rectangular area 12*b* along its cylindrical wall periphery as shown in FIG. 3. The construction prevents the bottom wall 12*a*, the plunger tube 20 and the second member 14 from accidentally falling into a container to which the entire capsule has been mounted. In this position, the container (which is not shown in FIG. 5) can still dispense the combined ingredients through lip 16 which includes apertures allowing the combined liquid in the container to be dispensed through the top of the container or through the neck of the container.

The present invention can also be used not only in a bottle that includes a neck and a screw on cap, but installed permanently in and through the wall of any carton, container, package or bottle. In this disposition, it would not be necessary to have apertures 18 shown in FIG. 1 in the annular lip 16. If the device is mounted through the body wall of any type of container whether it be a package, a milk carton, or any other type of liquid carton, then the entire capsule 10 would be sealed around the rim 16 to the container wall on the outside. The second member top would be visible and the major portion of the cylindrical body 16 mounted inside the particular container and its contents. In this way, once the second member is depressed and the ingredients in the capsule dispensed, the normal pouring spout of the particular container can be used for dispensing the mixed liquids.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A capsule that contains liquid and/or dry material to be subsequently dispensed into a container comprising:

a capsule body that is impervious to liquid;

said capsule body, including a first member and a second member, said second member moveable mountable in said first member;

said capsule first member body having a top opening and a sealed closed bottom with lines of weakening and a vertical plunger tube connected thereto;

said second member having a sealed closed top and an open bottom; and said first and second members in a first mode are sealed forming said capsule body preventing any liquid or dry material from escaping from the capsule body.

2. A capsule as in claim 1, wherein:

said first member is cylindrical and said second member is cylindrical; and the inside diameter of said first member being larger than the outside diameter of the said second member.

3. A capsule as in claim 2, wherein:

said first member side cylindrical wall and said sealed bottom having a joined area of weakened material around its periphery, for rupture by said second member engaging said plunger tube.

4. A capsule as in claim 2, wherein:

said first member inside wall has a sealing means that engages said second member.

5. A capsule as in claim 1, wherein:

said second member having a removeable area to form an aperture for inserting a straw.

* * * * *